US006854520B1

(12) United States Patent
Robichaux

(10) Patent No.: US 6,854,520 B1
(45) Date of Patent: Feb. 15, 2005

(54) APPARATUS AND METHOD FOR HANDLING A TUBULAR

(75) Inventor: Dicky Robichaux, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/129,167

(22) PCT Filed: Nov. 6, 2000

(86) PCT No.: PCT/GB00/04241

§ 371 (c)(1),
(2), (4) Date: Sep. 23, 2002

(87) PCT Pub. No.: WO01/33036

PCT Pub. Date: May 10, 2001

(30) Foreign Application Priority Data

| | | |
|---|---|---|
| Nov. 5, 1999 | (NO) | 995426 |
| Nov. 17, 1999 | (NO) | 995641 |
| Feb. 25, 2000 | (GB) | 0004354 |

(51) Int. Cl.[7] ..... E21B 19/15

(52) U.S. Cl. ..... 166/380; 166/77.1; 166/77.53; 166/85.1; 414/22.54; 414/22.62

(58) Field of Search ..... 166/77.1, 77.4, 166/77.53, 85.1, 377, 380; 175/52, 57, 85, 162, 220; 414/22.54, 22.58, 22.61–22.63

(56) References Cited

U.S. PATENT DOCUMENTS

| | | | | |
|---|---|---|---|---|
| 3,194,313 A | | 7/1965 | Fanshawe | 166/77.5 |
| 4,382,591 A | * | 5/1983 | Minnis et al. | 269/156 |
| 4,605,077 A | * | 8/1986 | Boyadjieff | 175/85 |
| 4,610,315 A | * | 9/1986 | Koga et al. | 175/85 |
| 4,762,185 A | * | 8/1988 | Simpson | 175/5 |
| 6,158,516 A | * | 12/2000 | Smith et al. | 166/385 |

OTHER PUBLICATIONS

International Preliminary Examination Report dated Apr. 25, 2002, for application Serial No. PCT/GB00/04241.

* cited by examiner

*Primary Examiner*—Zakiya Walker
(74) *Attorney, Agent, or Firm*—Moser, Patterson & Sheridan, L.L.P.

(57) ABSTRACT

An apparatus for inserting or removing a string of tubulars from a borehole includes a makeup/break out mechanism which is capable of adding a tubular to or removing a tubular from the string and handling mechanism which feeds a tubular into, or removes a tubular from, the make up/break out mechanism. The make up/break out mechanism is moveable along the direction parallel to the axial direction of the string, such that the string may be substantially continuously inserted into or removed from the borehole.

26 Claims, 17 Drawing Sheets

APPARATUS AND METHOD FOR HANDLING A TUBULAR

The present invention relates to an apparatus and method of inserting and/or removing tubulars from boreholes in the ground or subsea surface, and also to an apparatus and method for use in workovers, well maintenance and well intervention, and particularly, but not exclusively relates to apparatus and method for use in hydrocarbon exploration, exploitation and production, but could also relate to other uses such as water exploration, exploitation and production.

Conventional drilling operations for hydrocarbon exploration, exploitation and production utilise many lengths of individual tubulars which are made up into a string, where the tubulars are connected to one another by means of screw threaded couplings provided at each end. Various operations require strings of different tubulars, such as drill pipe, casing and production tubing.

The individual tubular sections are made up into the required string which is inserted into the ground by a make up/break out unit, where the next tubular to be included in the string is lifted into place just above the make up/break out unit. A first conventional method of doing this uses a single joint elevator system which attaches or clamps onto the outside surface of one tubular section and which then lifts this upwards. A second conventional method for doing this utilises a lift nubbin which comprises a screw thread which engages with the box end of the tubular such as drill pipe, and the lift nubbin and tubular are lifted upwards by a cable. However, this second method in particular can be relatively dangerous since the lift nubbin and tubular will tend to sway uncontrollably as they are being pulled upwards by the cable.

From a second aspect, conventional drilling rigs utilise a make up/break out system to couple/decouple the tubular pipe sections from the tubular string. A conventional make up/break out system comprises a lower set of tongs which are brought together to grip the lower pipe like a vice, and an upper set of tongs which firstly grip and then secondly rotate the upper pipe relative to the lower pipe and hence screw the two pipes together. In addition to this conventional make up/break out system, a conventional drilling rig utilises a rotary unit to provide rotation to the drill string to facilitate drilling of the borehole, where the conventional rotary unit is either a rotary table provided on the drill rig floor or a top drive unit which is located within the drilling rig derrick.

According to a first aspect of the present invention there is provided an apparatus for handling tubulars, the apparatus comprising a pair of substantially vertical tracks;

a rail mechanism movably connected to each track; and a coupling mechanism, associated with the rail mechanism, for coupling to a tubular; and a movement mechanism to provide movement to the rail mechanism.

According to a second aspect of the present invention there is provided a method of handling tubulars, the method comprising:— providing a rail mechanism, the rail mechanism being associated with a coupling mechanism for coupling to a tubular, and the rail mechanism being movably connected to a substantially vertical track;

coupling the coupling mechanism to a tubular; and operating a movement mechanism to move the rail mechanism.

The substantially vertical tracks are preferably secured to a frame which is typically a derrick of a drilling rig. The pair of substantially vertical tracks are preferably arranged about the longitudinal axis of a borehole mouth, such that the pair of tracks and the borehole mouth lie on a common plane, with one track at either side of the borehole mouth.

Preferably, the rail mechanism is suitably connected to the respective track by any suitable means such as runners or rollers and the like.

The movement mechanism may comprise a motive means associated with the runners or rollers and the like. Alternatively, the movement mechanism may comprise a cable, winch or the like coupled at one end to the rail mechanism and coupled at the other end to a motor and real arrangement or a suitable counterweight arrangement or a suitable counterbalance winch hoisting or the like.

Preferably, the coupling mechanism comprises a suitable coupling for coupling to the tubular, where the suitable coupling may comprise a member provided with a screw thread thereon for screw threaded engagement with one end of the tubular. Alternatively, the suitable coupling may comprise a vice means to grip the end of the tubular. Alternatively, the suitable coupling may comprise a fluid swivel which couples directly to the end of the tubular, or indirectly to the end of the tubular via a kelly. Typically, the derrick may be provided with a tubular rack for storing tubulars, and a ramp which may extend downwardly at an angle from the lower end of the derrick toward the tubular rack, and a tubular guide track may also be provided at one or both sides of the ramp.

According to a third aspect of the present invention there is provided an apparatus for handling a tubular, the apparatus comprising at least one substantially vertical track;

a coupling mechanism, connected to the track, for coupling to a tubular;

a pair of moveable members which are hingedly connected to both the coupling mechanism and the vertical track, such that movement of the pair of moveable members results in movement of the coupling mechanism substantially about a longitudinal axis of the track.

According to a fourth aspect of the present invention there is provided a method of handling a tubular, the method comprising providing at least one substantially vertical track;

connecting a coupling mechanism to the track, the coupling mechanism for coupling to a tubular;

providing a pair of moveable members which are hingedly connected to both the coupling mechanism and the vertical track; and moving the pair of moveable members to move the coupling mechanism substantially about a longitudinal axis of the track.

Preferably, a rail mechanism is provided and which is movably connected to the track, and typically, the coupling mechanism is associated with the rail mechanism. More preferably, the pair of movable members are hingedly connected to both the coupling mechanism and the rail mechanism.

Preferably, there are a pair of substantially vertical tracks, and the substantially vertical tracks are preferably secured to a frame which is typically a derrick of a drilling rig. The pair of substantially vertical tracks are preferably arranged about the longitudinal axis of a borehole mouth, such that the pair of tracks and the borehole mouth lie on a common plane, with one track at either side of the borehole mouth. Typically, the movement of the pair of movable members results in movement of the coupling mechanism substantially about the longitudinal axis of the track such that a longitudinal axis of a tubular coupled to the coupling mechanism is substantially coincident with the longitudinal axis of the borehole mouth.

Preferably, a motive means is provided to permit movement of the pair of moveable members, where the motive means may be a suitable motor such as a hydraulic motor.

According to a further aspect, the present invention provides an apparatus for inserting or removing a string of tubulars from a borehole, the apparatus comprising:— a make up/break out mechanism which is capable of adding a tubular to or removing a tubular from the string;

a handling mechanism which is adapted to feed a tubular into, or remove a tubular from, the make up/break out mechanism;

characterised in that the make up/break out mechanism is moveable along the direction parallel to the axial direction of the string, such that the string may be substantially continuously inserted into or removed from the borehole.

According to yet a further aspect, the present invention provides a method of inserting or removing a string of tubulars from a borehole, the method comprising:— providing a make up/break out mechanism which is capable of adding a tubular to or removing a tubular from the string;

providing a handling mechanism which is adapted to feed a tubular into, or remove a tubular from, the make up/break out mechanism; and moving the make up/break out mechanism along the direction parallel to the axial direction of the string as it is adding a tubular to or removing a tubular from the string, such that the string is substantially continuously inserted into or removed from the borehole.

Preferably, the make up/break out mechanism comprises a pair of vertically spaced slips which are adapted to selectively grip the tubulars, wherein one of the slips is moveable towards and/or away from the other slips.

Typically, the make up/breakout mechanism further comprises a movement mechanism which is capable of moving the said one slip toward or away from the said other slip.

The movement mechanism may further comprise one or more jacking cylinders, and the make up/breakout mechanism preferably further comprises a pair of vertically spaced tongs which are adapted to selectively grip the tubulars. More preferably, the uppermost tong is adapted to impart rotation to a tubular.

The make up/breakout mechanism may further comprise a movement mechanism which is capable of moving the pair of vertically spaced tongs toward or away from a mouth of the borehole.

The movement mechanism which is capable of moving the pair of vertically spaced tongs toward or away from a mouth of the borehole is preferably the same movement mechanism which is capable of moving the said one slip toward or away from the said other slip.

Embodiments of the invention will now be described, by way of example only, with reference to the accompanying drawings, in which:—

Figure 1:
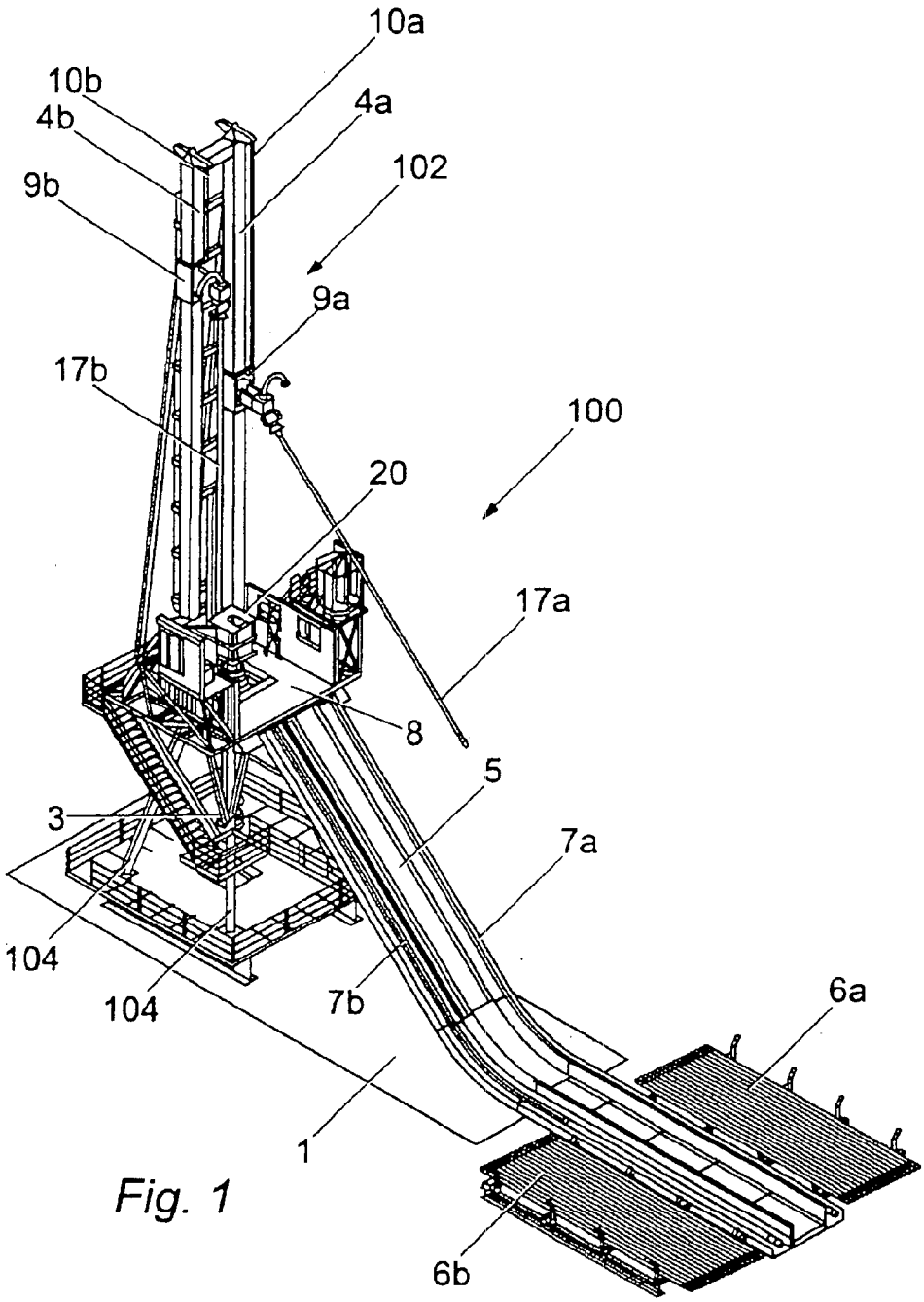
FIG. 1 is a perspective view of a drilling rig incorporating aspects of the present invention.
Figure 2:
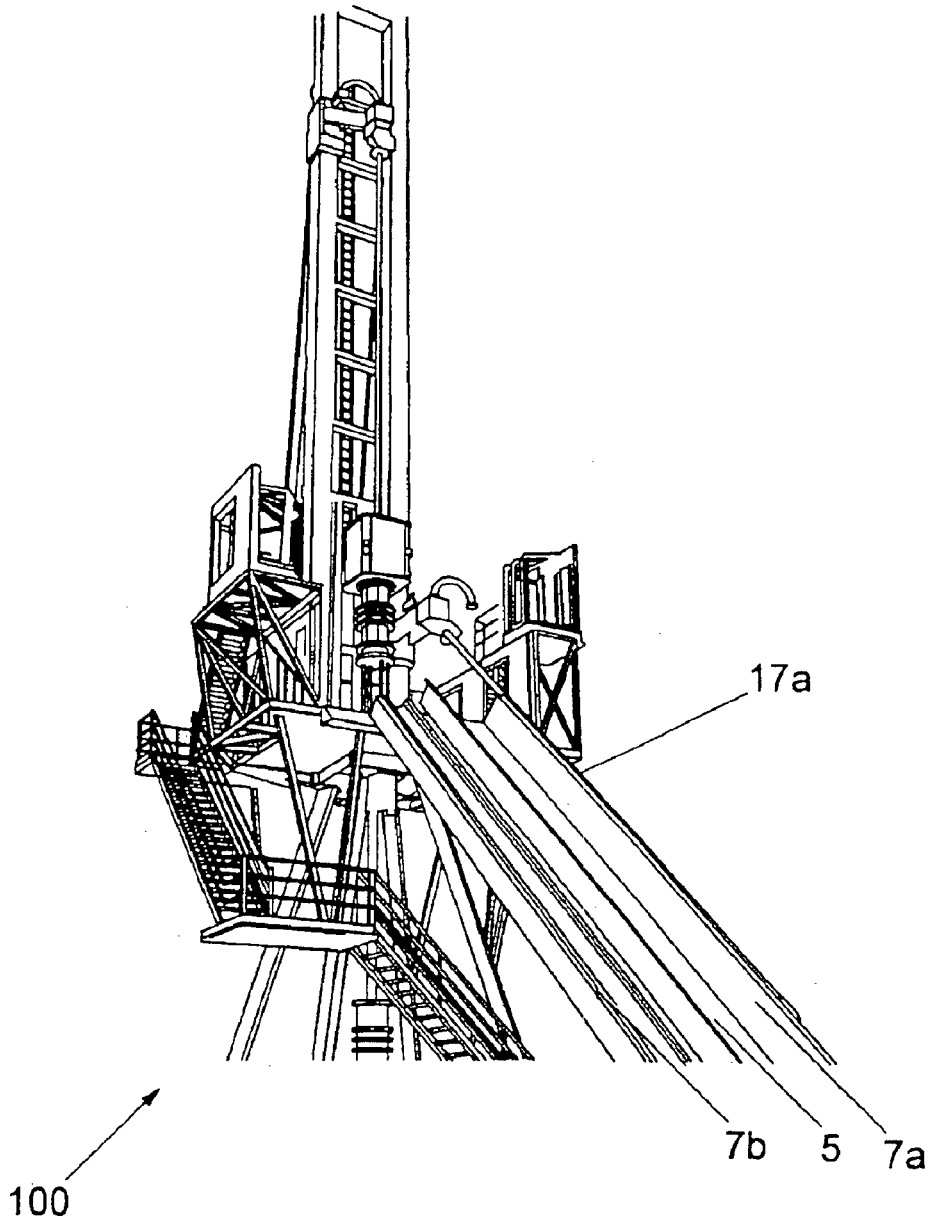
FIG. 2 is a portion of the drilling rig of FIG. 1 in a first configuration.
Figure 3A:
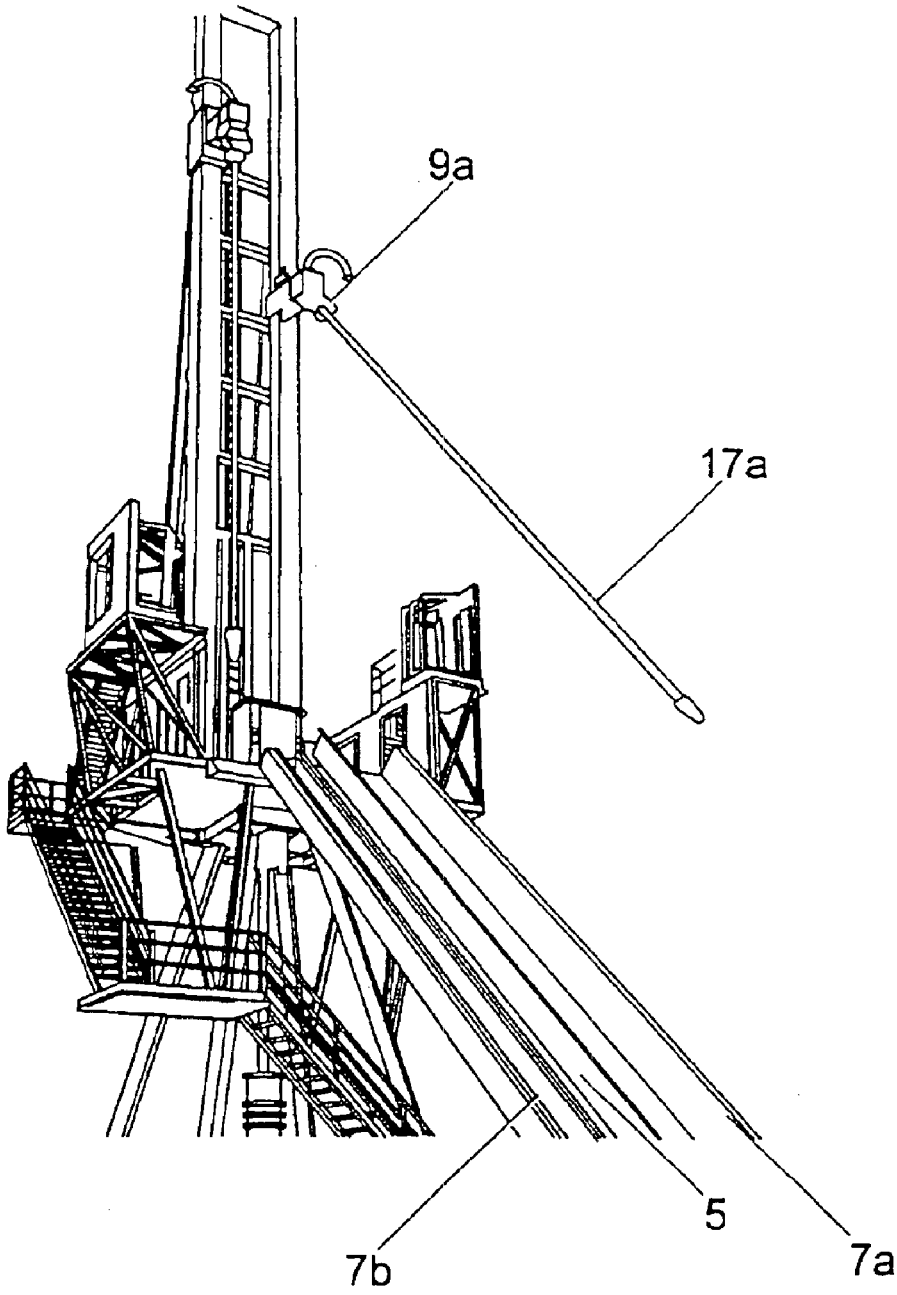
Figure 3B:
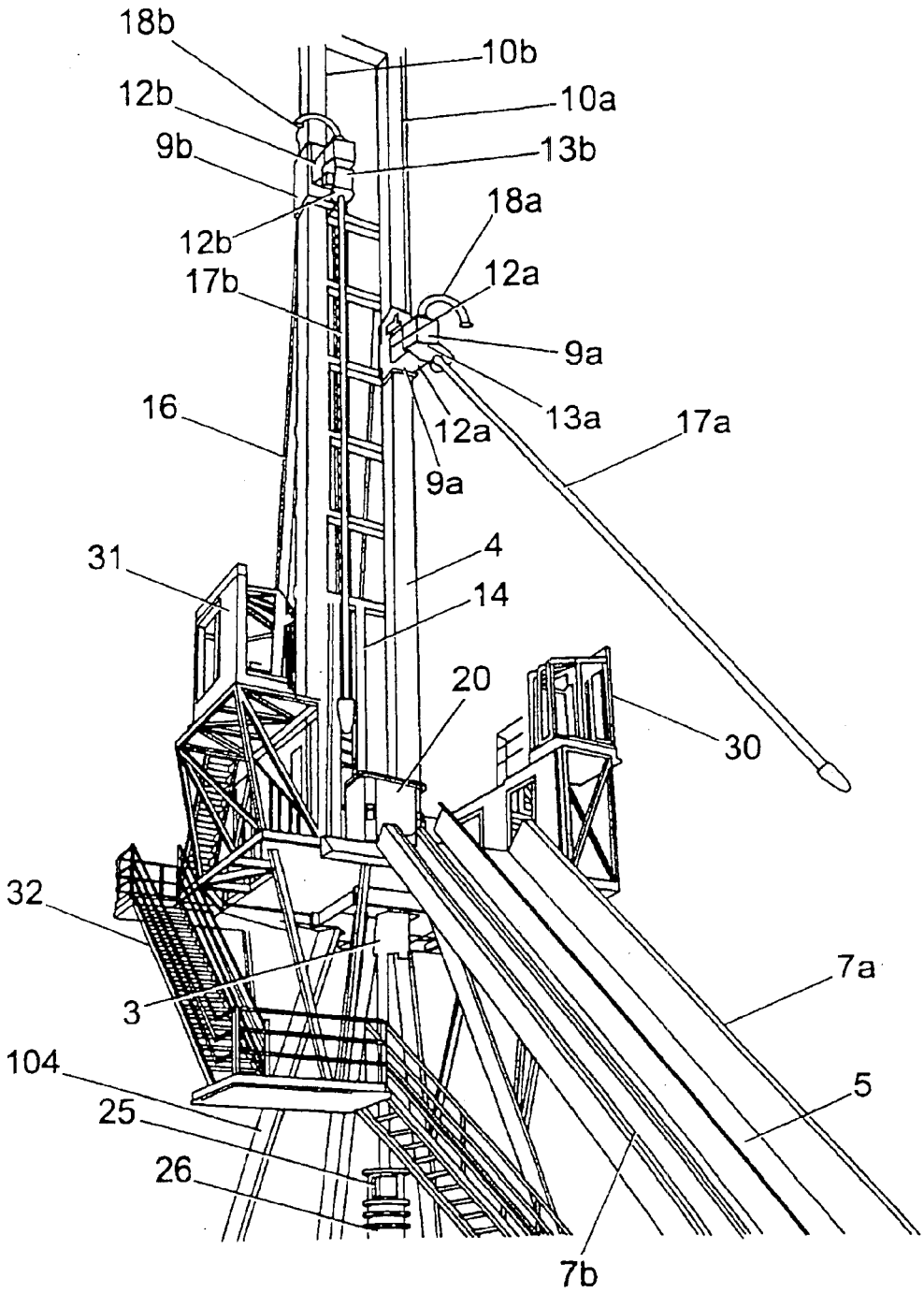

FIG. 3*a* is a portion of the drilling rig of FIG. 1 in a second configuration;

FIG. 3*b* is a more detailed perspective view of the portion of the drilling rig of FIG. 3*a;*

Figure 4:
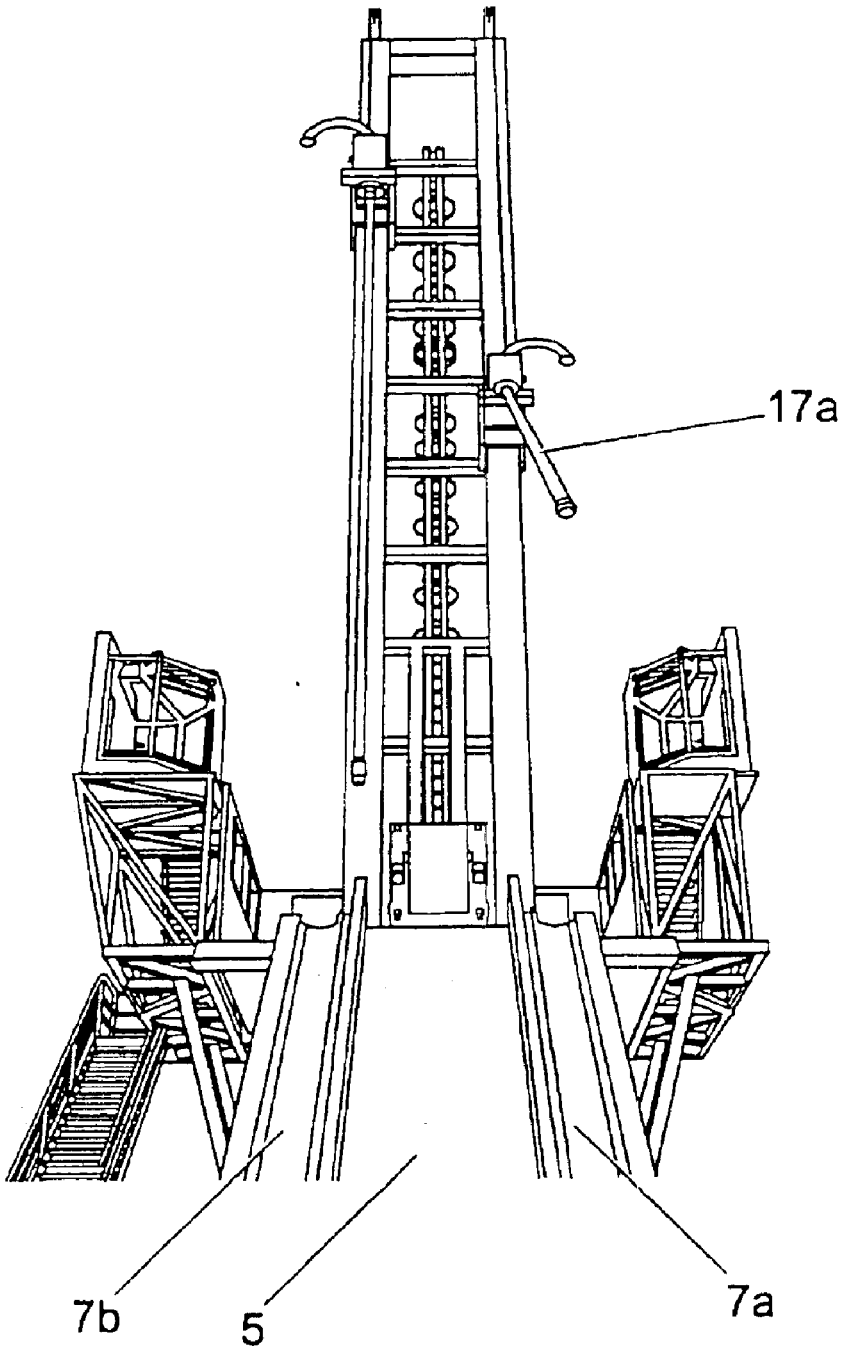

FIG. 4 is a front perspective view of a portion of the drilling rig of FIG. 3*a;*

Figure 5:
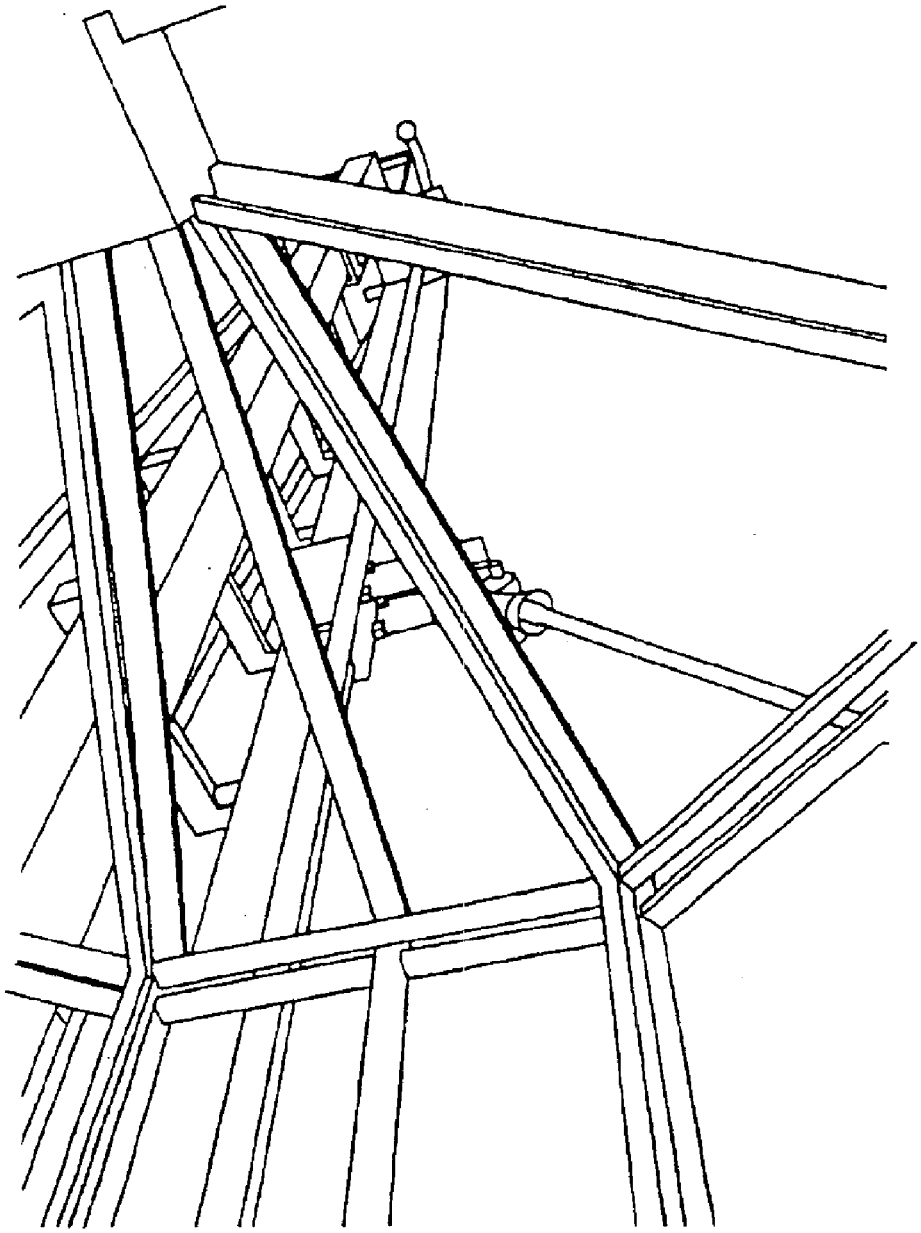

FIG. 5 is a perspective view looking upwardly at the portion of the drilling rig of FIG. 3*a;*

Figure 6:
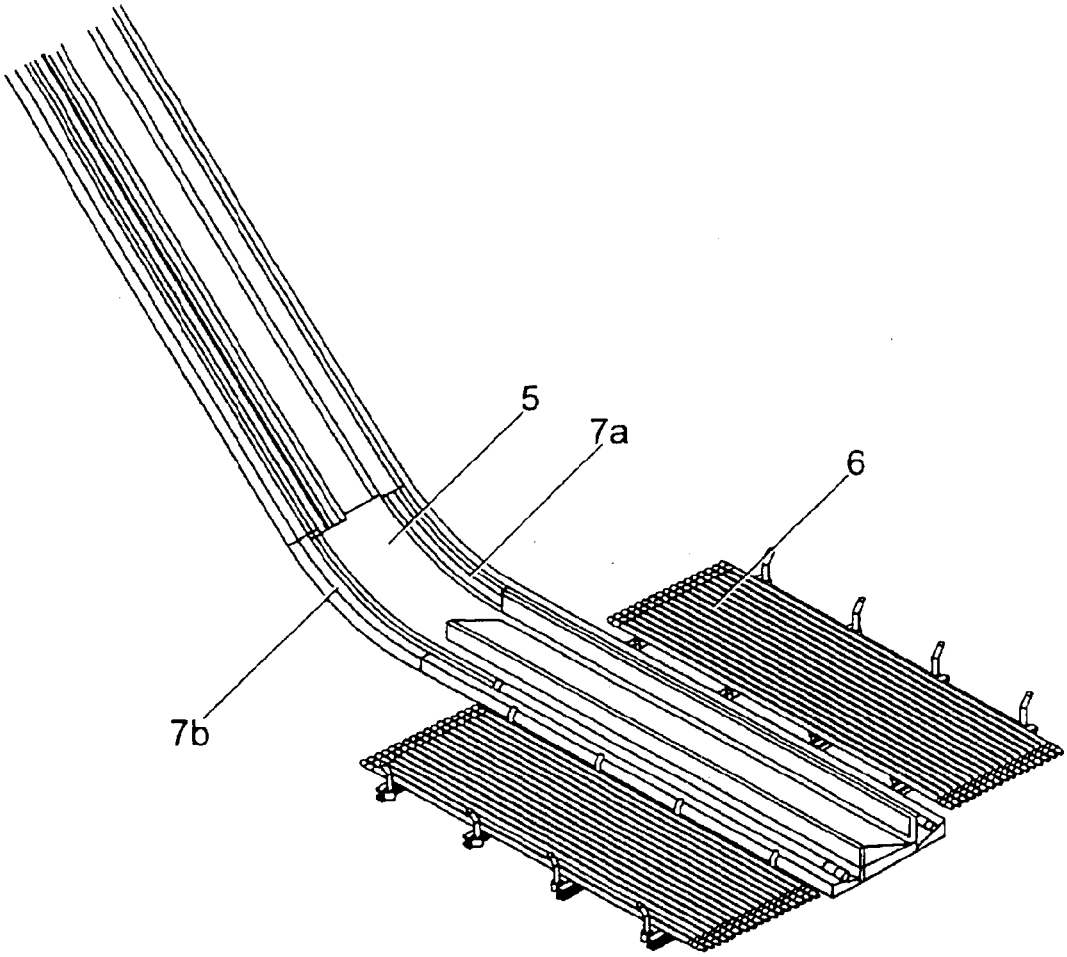
Figure 7A:
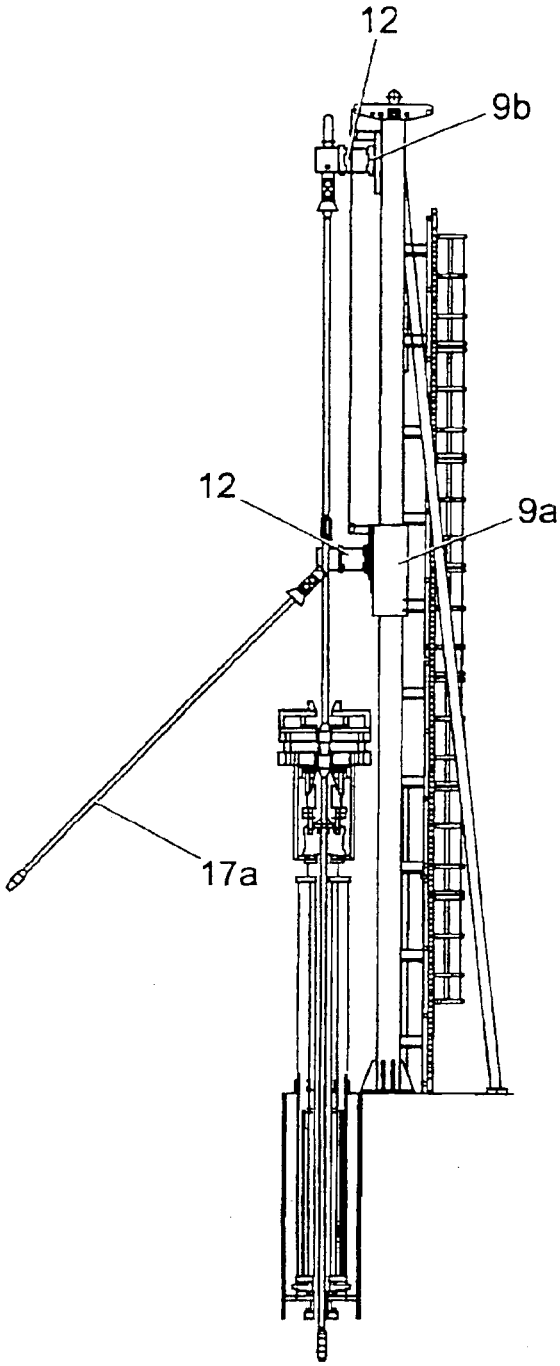
Figure 7B:
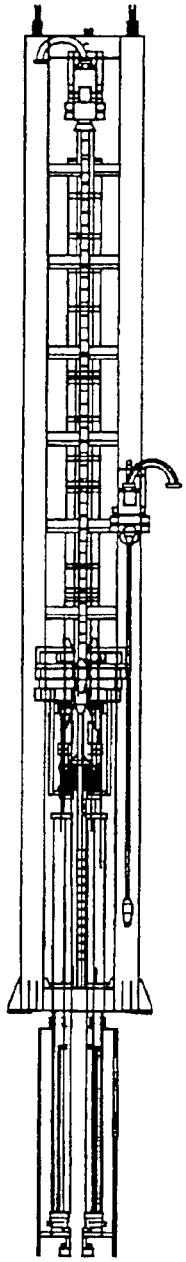

FIG. 6 is a perspective view of a ramp and drill pipe loading area of the drilling rig of FIG. 1;

FIG. 7*a* is a cross-sectional side view of the derrick of the drilling rig of FIG. 1;

FIG. 7*b* is a front view of the derrick of FIG. 7*a;*

Figure 8A:
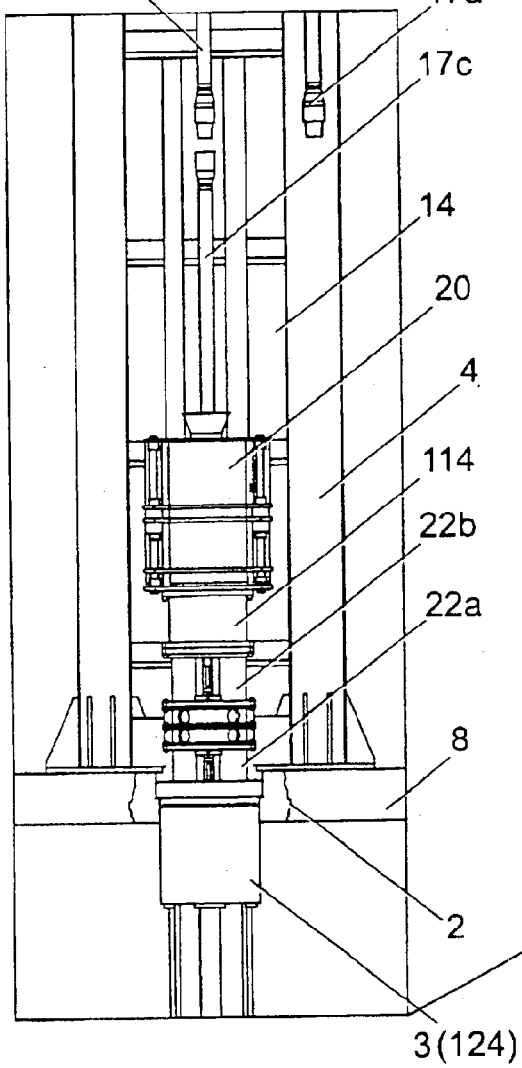
Figure 8B:
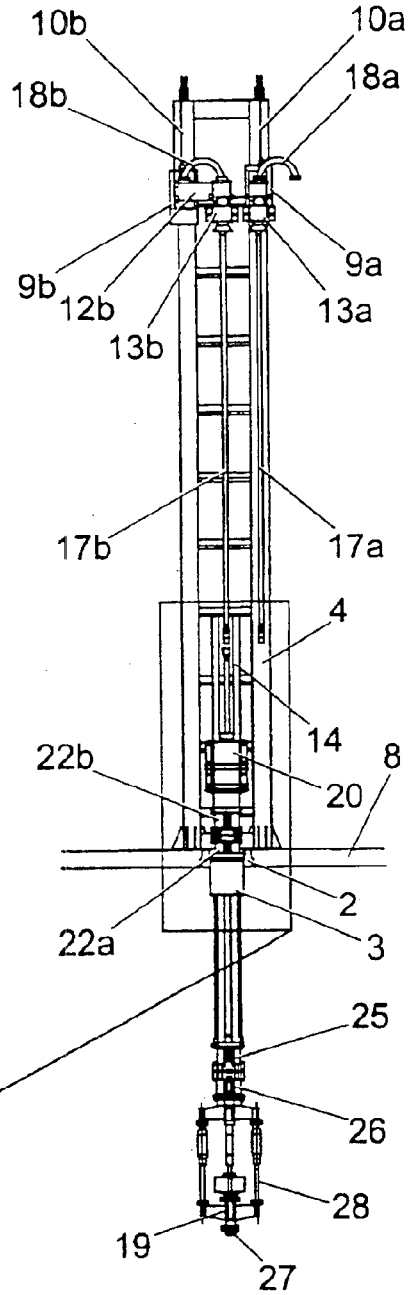

FIG. 8*a* is a cross-sectional more detailed view of a portion of the apparatus of FIG. 8*b;*

Figure 9A:
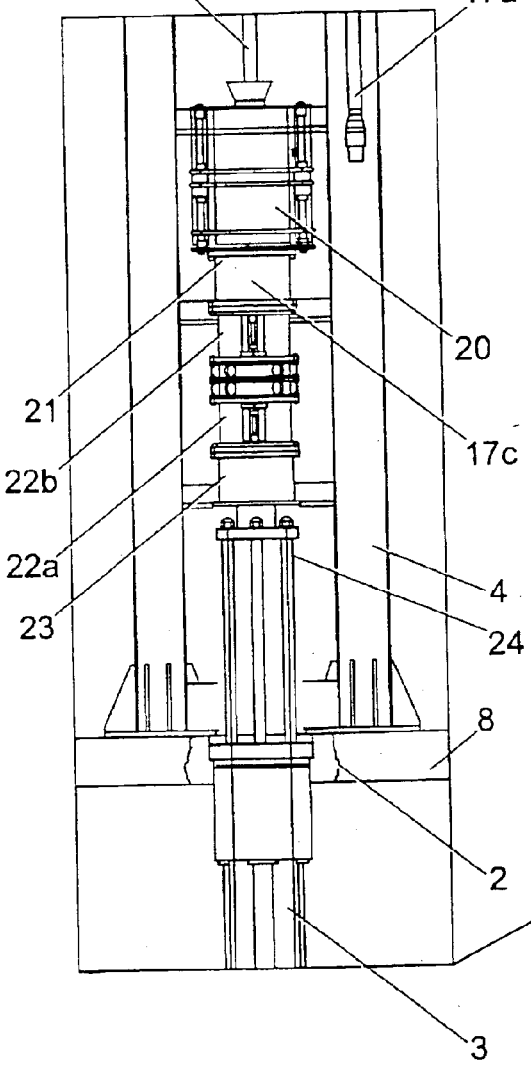
Figure 9B:
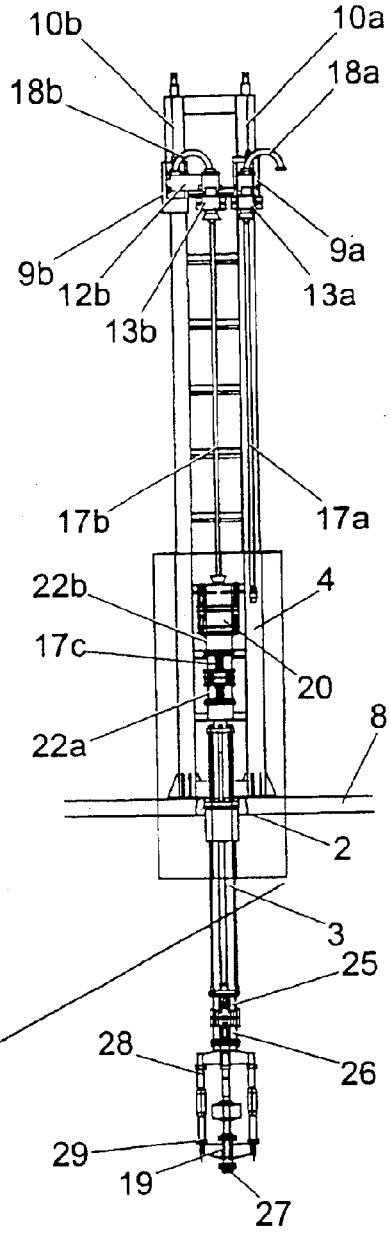

FIG. 8*b* is a front cross-sectional view of a portion of the derrick of the drilling rig of FIG. 1;

FIG. 9*a* is a cross-sectional more detailed view of a portion of the derrick of FIG. 9*b;*

Figure 10A:
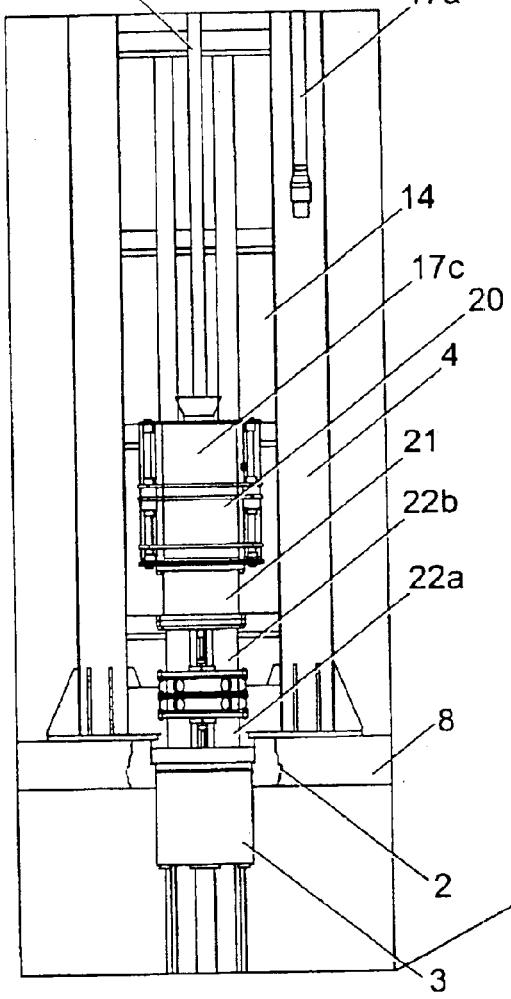
Figure 10B:
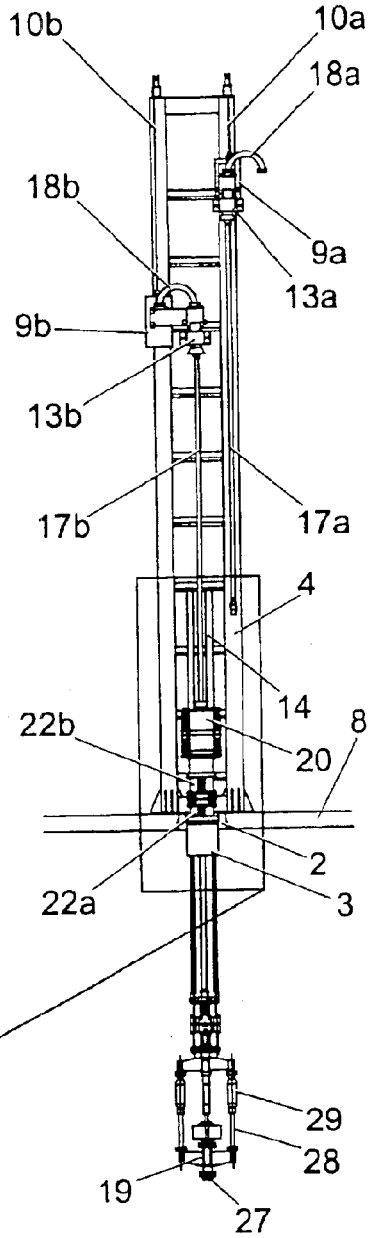

FIG. 9*b* is a front cross-sectional view of the derrick of the drilling rig of FIG. 1;

FIG. 10*a* is a more detailed view of a portion of the apparatus of FIG. 10*b;*

Figure 11A:
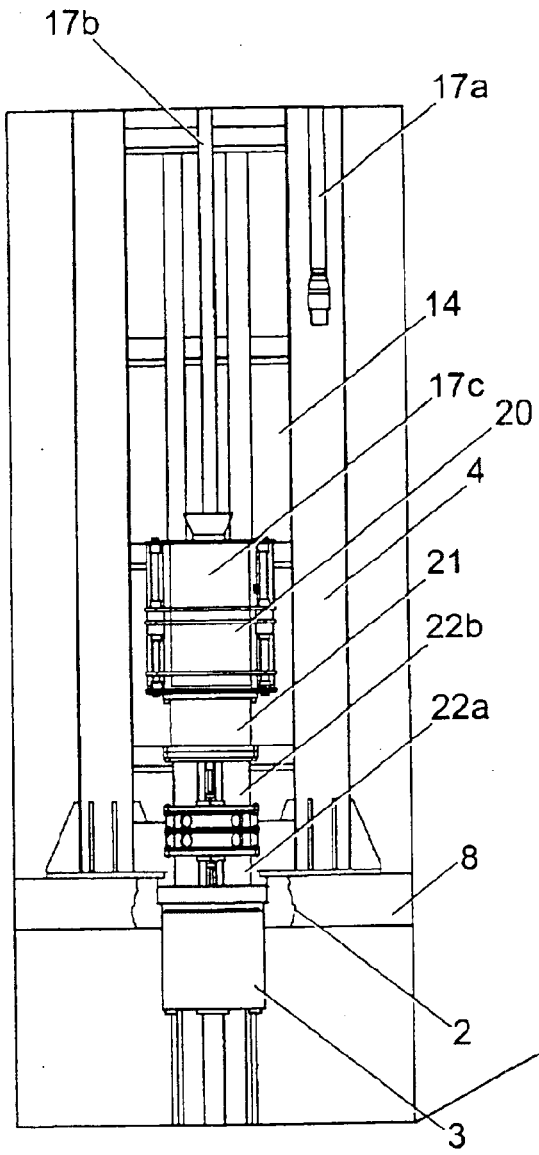
Figure 11B:
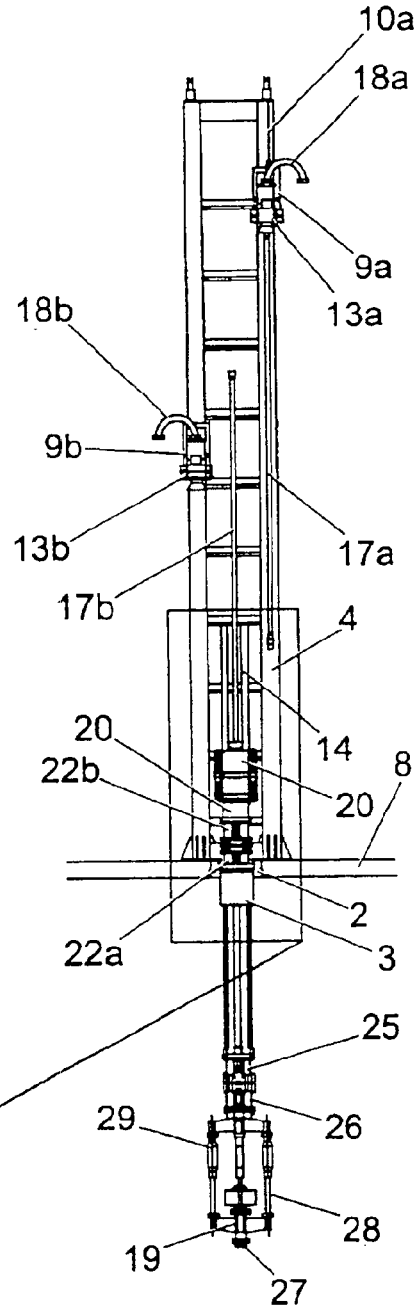

FIG. 10*b* is a front view of the derrick of FIG. 1;

FIG. 11*a* is a more detailed view of a portion of the apparatus of FIG. 11*b;*

Figure 12A:
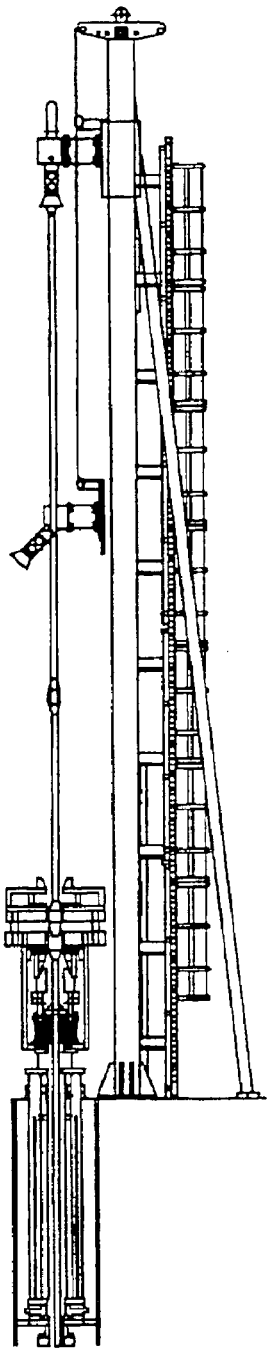
Figure 12B:
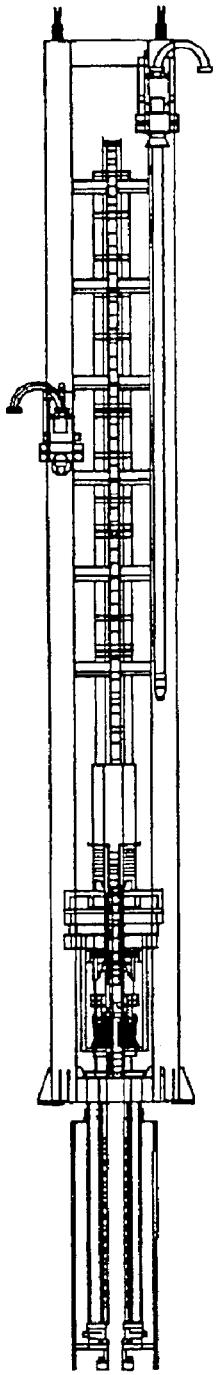
Figure 13A:
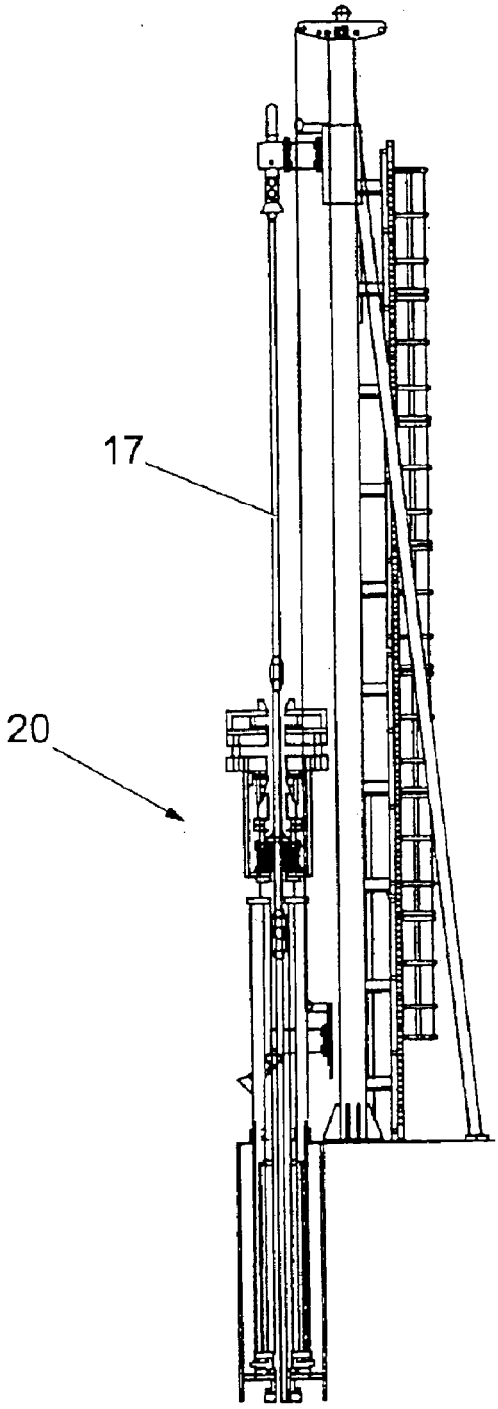
Figure 13B:
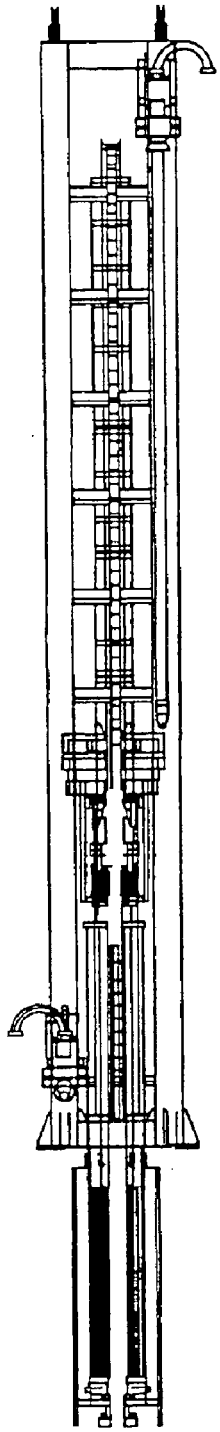
Figure 14A:
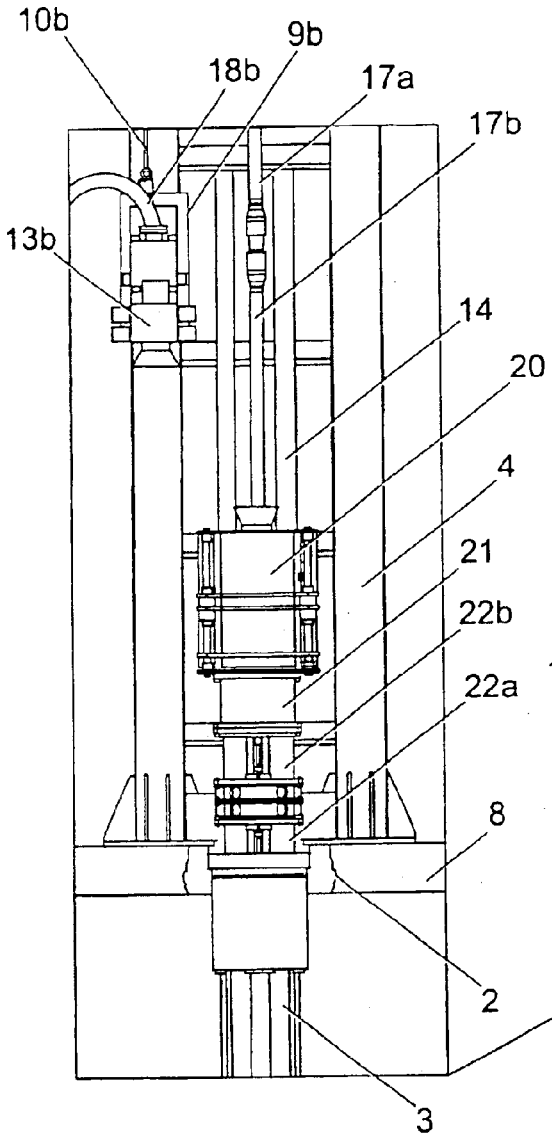
Figure 14B:
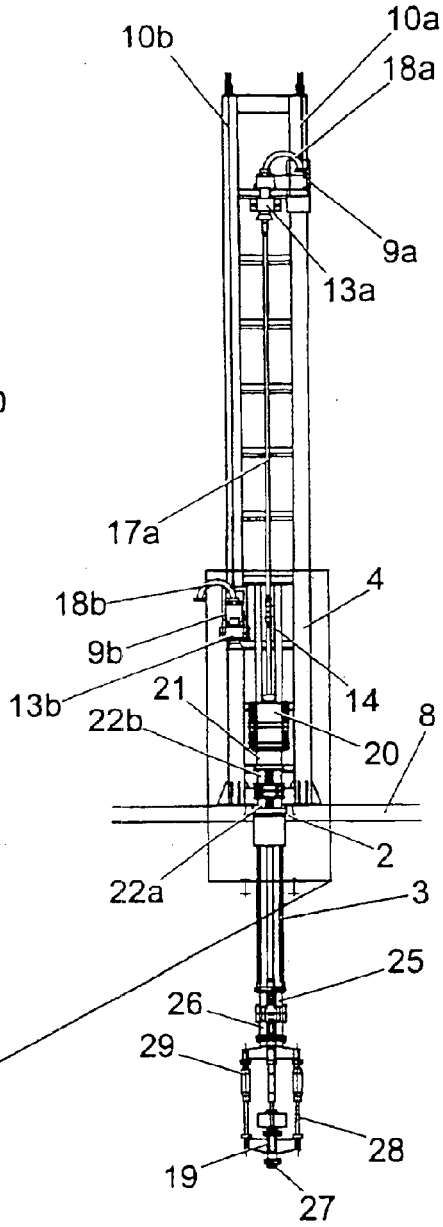

FIG. 11*b* is a front view of the derrick of FIG. 1;

FIG. 12*a* is a side view of the derrick of FIG. 1;

FIG. 12*b* is a front view of the derrick of FIG. 1;

FIG. 13*a* is a side view of the derrick of FIG. 1;

FIG. 13*b* is a front view of the derrick of FIG. 1;

FIG. 14*a* is a more detailed view of the portion of the apparatus of FIG. 14*b;*

Figure 15A:
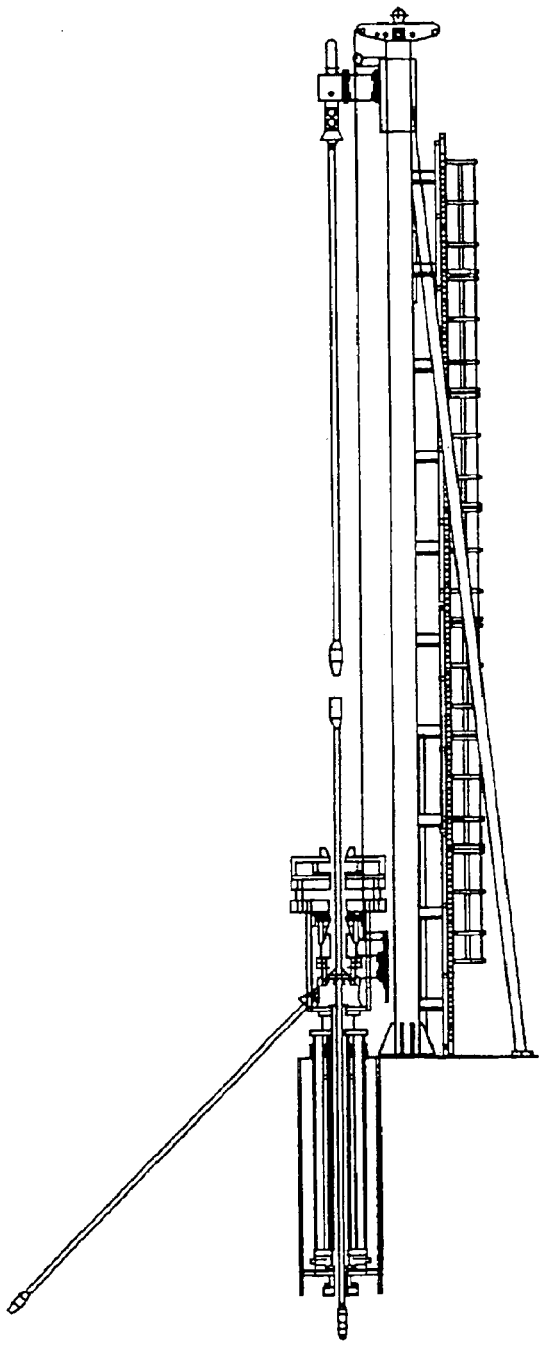
Figure 15B:
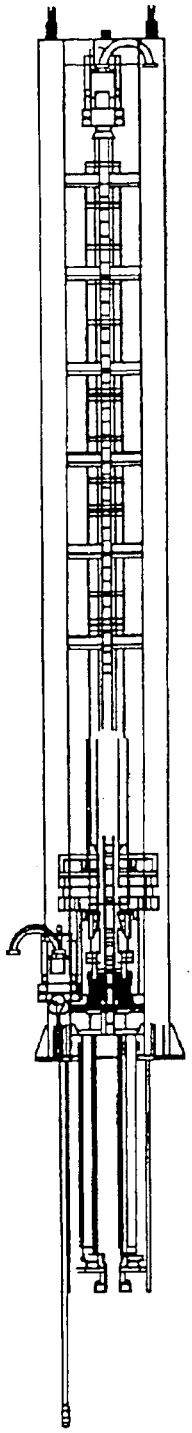
Figure 16A:
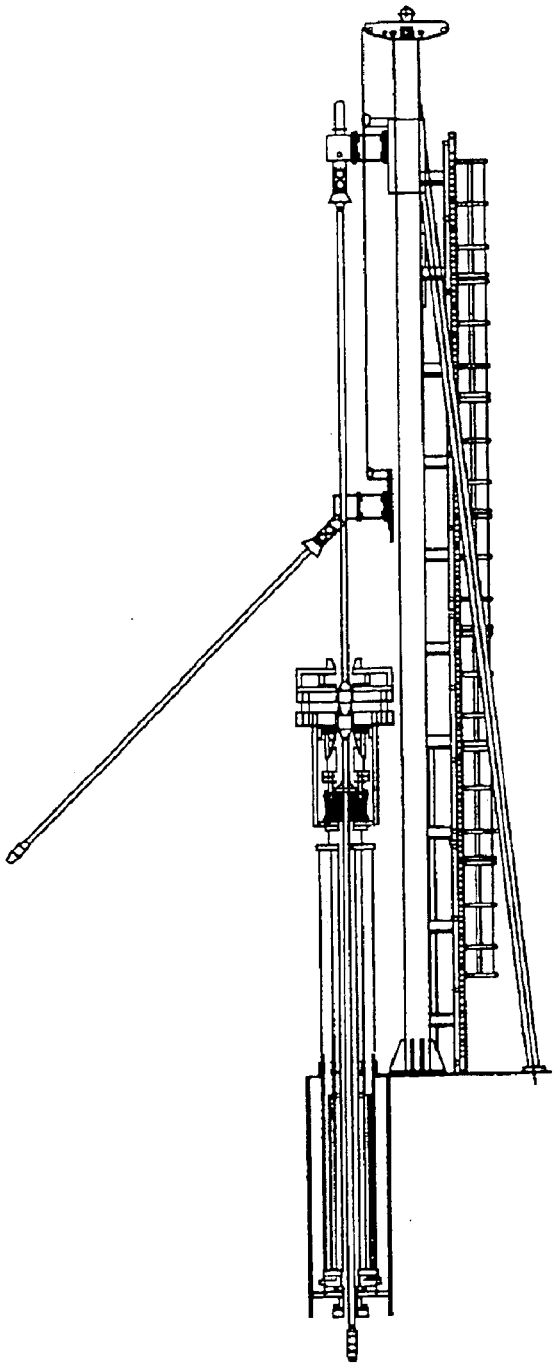
Figure 16B:
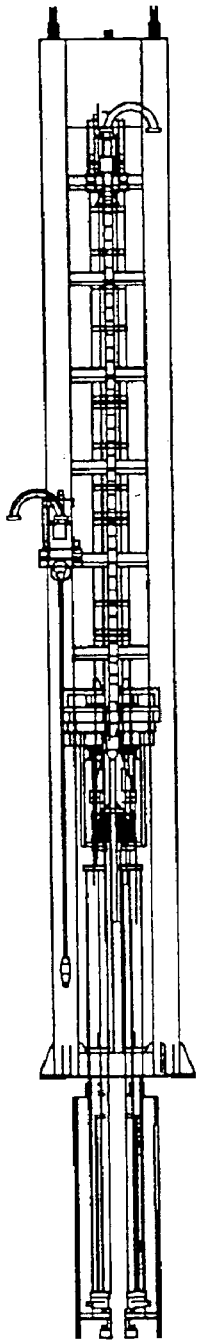

FIG. 14*b* is a front view of the derrick of FIG. 1;

FIG. 15*a* is a side view of the derrick of FIG. 1;

FIG. 15*b* is a front view of the derrick of FIG. 1;

FIG. 16*a* is a side view of the derrick of FIG. 1;

FIG. 16*b* is a front view of the derrick of FIG. 1;

FIG. 1 shows a drilling rig generally designated at 100. The drilling rig 100 is particularly suited for use in the business of exploration, exploitation and production of hydrocarbons, but could also be used for the same purposes for other gases and fluids such as water. With regard to hydrocarbons, the drilling rig 100 can be used for operations such as, but not limited to, snubbing, side tracks, under balanced drilling, work overs and plug and abandonments. The drilling rig 100 can be utilised for land operations, (as shown in FIG. 1) as well as in marine operations since it can be modified to be installed on an offshore drilling rig, a drill ship or other floating vessels.

The drilling rig 100 comprises a derrick 102 which extends vertically upwardly from a rig floor 8, where the rig floor 8 is carried by a suitable arrangement of supports 104 which are secured by appropriate means to the ground 1 or floating vessel top side 1.

As can be seen in FIGS. 1 to 4 and 6, the drilling rig 100 optionally includes a ramp 5 which extends downwardly at an angle from the rig floor 8. The ramp 5 can be used by personnel as an evacuation slide 5 if it is required that the personnel quickly evacuate the drilling rig 100. A drill pipe guide track 7*a*, 7*b* is located at each side of the slide 5 and which fully extends from the drill rig floor 8 to the ground 1. A drill pipe rack 6*a*, 6*b* is located at the outer side of each respective drill pipe guide track 7*a*, 7*b*, where the rack 6*a*, 6*b* is capable of holding a plurality of tubular drill pipe lengths, such as drill pipe 17. Each rack 6*a*, 6*b* comprises two or more kickover troughs (not shown) spaced along the length of the rack 6*a*, 6*b*, where the troughs can be operated to move lengths of drill pipe 17 from the rack 6*a*, 6*b* to the respective track 7*a*, 7*b* or vice versa as required, and do this by being angled either respectively inwardly or outwardly by approximately two or three degrees either way. A rope or counterbalance winch arrangement (not shown) is also provided for each pipe guide track 7, such that the rope/winch arrangement can be operated to pull pipes 17 from the lower end of the track 7*a*, 7*b* up to the drill rig floor 8. The rope/winch arrangement can also be operated to lower pipe 17 from the drill rig floor a to the lower end of the track 7*a*, 7*b*.

It should however be noted that the downwardly angled fire evacuation slide 5 is an optional feature of the drilling rig 100.

FIG. 1 also shows an arm runner 9*a*, 9*b* being moveably located on a respective derrick dolly track 4*a*, 4*b*. As shown in FIGS. 3*b*, 7*a* and 8*b* for example, each arm runner 9*a*, 9*b* is provided with a pair of articulated pipe arms 12 which are hingedly attached at one end to the respective arm runner 9*a*, 9*b* and are hingedly attached at the other end to a respective pipe handler fluid swivel 13*a*, 13*b*. This arrangement allows the fluid swivel 13*a*, 13*b* to be moved, by means of suitable motors (not shown), inwardly from the plane parallel to the longitudinal axis of the respective dolly track 4*a*, 4*b* to the plane parallel with the longitudinal axis of the borehole, such that the articulated pipe arms 12 act like a collapsible parallelogram. A respective goose neck pipe 18*a*, 18*b* is provided at the upper end of the respective fluid swivel 13*a*, 13*b* and is in sealed fluid communication with the internal bore of the respective fluid swivel 13*a*, 13*b*. A suitable pipe end coupling is provided at the lower end of each fluid swivel 13, where this pipe end coupling may suitably be a screw thread coupling for connection with the box end of a drill pipe 17. A wire pulley 10*a*, 10*b* is provided for each arm runner 9, and is secured at one end to the upper portion of the arm runner 9, where the other end of the wire pulley 10 is coupled to a suitable lifting/lowering mechanism, which may be a motor and reel arrangement, or may be a suitable counter weight arrangement, or may be a suitable counter balance winch hoisting (not shown).

A method of operating the pipe handling mechanism, in accordance with an aspect of the present invention, will now be described. Drill pipe 17*a* is lifted up one of the guide tracks 7*a* as previously described, until the upper end of the drill pipe 17*a* is located in relatively close proximity to the pipe coupling provided on the first pipe handler swivel 13*a*. The box end of the drill pipe 17*a* is then coupled to the pipe end coupling of the fluid swivel 13*a*, such that the pipe handling mechanism is in the configuration shown in FIG. 2. The cable 10*a* lifting/lowering mechanism is then operated such that the arm runner 9*a*, and hence drill pipe 17*a* is lifted upwardly to the configuration shown in FIGS. 1, 3*a*, 3*b*, 4, 5, 7*a* and 7*b*, until the arm runner 9*a* and hence drill pipe 17*a* are in the configuration shown in FIGS. 8*a* and 8*b*. It should be noted that it is preferred that the drill pipe 17*a* is lifted upwardly at a downwardly projecting angle, and this provides the advantage that the lower end of the drill pipe 17*a* is kept well clear of the rig floor 8.

However, it should be noted that the other arm runner 9*b* and drill pipe 17*b* have already been moved in a similar manner, and the associated motor has been operated to move the drill pipe 17*b* such that the articulated pipe arms 12 have moved inward and the drill pipe 17*b* is co-axial with the borehole.

A remote control and instrumentation console may also be provided and which features direct acting hydraulic control valves (not shown) to provide control for the following:— i) Tong motor direction manual directional control which uses a Danfoss PGV 120™ load independent proportional hydraulic control valve assembly (not shown) for open loop power unit with a manual lever operated valve section to control the tong motor with flow rates to 47.6 gpm.

ii) Tong torque limiter (manual preset for automatic dumping, and an electronic solenoid can add computer dump control).

iii) Tong backing pin.

iv) Hydraulic system pressure control.

v) Braking system control.

vi) Torque gauge (hydraulic style) with dampener valve.

vii) Hydraulic system pressure gauge.

Referring now back to FIG. 8*a*, a tripping operation into an already drilled borehole will now be described. By way of explanation, a tripping operation is performed to insert tools required in the borehole for a specific downhole operation. With boreholes being many thousands of feet deep, the length of drill pipe 17 must be included in the drill string and inserted into the borehole as quickly as possible.

A make up/breakout mechanism will now be described. FIG. 8*a* shows the upper end of drill pipe 17*c* projecting upwardly from the snubbing unit 20. At this point, the fixed slips 124, which are located within a fixed slip housing 3, are energised to firmly grip against the outer surface of the lower end of drill pipe 17*c*, such that the fixed slips 124 are holding the entire weight of the drill string. Four hydraulic jacking cylinders 24 (shown in FIG. 9(*a*)) are then actuated to raise the snubbing unit 20 upwards until it reaches the position shown in FIGS. 7*a* and 9*a*, such that the upper end of drill pipe 17*c* and lower end of drill pipe 17*b* are located within the snubbing unit 20.

The travelling slips 114 are then energised to engage the outer surface of drill pipe 17*c* just below the upper end thereof. The jaws of a lower tong, which is located within the lower half of the snubbing unit 20, are then energised to engage the outer surface of drill pipe 17*c* immediately below the upper end thereof and the jaws of a rotatable upper tong, which is located within the upper half of the snubbing unit 20, are energised to engage the outer surface of drill pipe 17*b* immediately above the lower end thereof. The fixed slips 124 are then released and the hydraulic jacking cylinders 24 are then actuated to move the snubbing unit 20 downwardly. Simultaneously, the upper tong is operated to rotate drill pipe 17*b* relative to drill pipe 17*c* such that the two joints thereof are made up to the required torque level. Therefore, by the time snubbing unit 20 has reached the position shown in FIG. 10*a*, the joint between drill pipe 17*b* and 17*c* has been made up. The pipehandler fluid swivel 13*b* can then be disengaged from the upper end of drill pipe 17*b* and can be moved downwardly on the arm runner 9*b*, as shown in FIGS. 11*b* and 12*b* to pick up another pipe 17. The fixed slips 124 are then re-energised to engage the outer surface of drill pipe 17*b*, and when this has been done, the engagement between upper tong, and lower tong and the respective drill pipe 17*b*, 17*c* can be released. The hydraulic jacking cylinders 24 are then actuated once more such that the snubbing unit 20 moves to the configuration shown in FIG. 13*a*. The travelling slips 114 are re-energised to grip the drill pipe 17 and the fixed slips 124 are released. The hydraulic jacking cylinders 24 are then actuated to move downwardly such that the snubbing unit 20 and travelling slips 114 stroke the drill string 17 into the borehole. A typical length of travel of the hydraulic jacking cylinders 24, and hence stroke of the drill string 17, is 13 feet. The snubbing unit 20 therefore moves from the configuration shown in FIG. 13*a* to the configuration shown in the FIGS. 14*a* and 15*a*.

Additionally, articulated pipe arms 12*a* have moved pipe 17*a* to be co-axial with the drill pipe 17*b*.

The fixed slips 124 are once again energised to engage the drill pipe 17*b* and the travelling slips 114 are released, such that the hydraulic jacking cylinders 24 move the snubbing unit 20 to the configuration shown in FIG. 16*a* so that the upper end and lower end of respective drill pipes 17*b* and 17*a* are located within the snubbing unit 20.

This process is repeated for as many drill pipe 17 sections as required in order to make up the desired length of drill string 17.

This process provides an extremely quick make up (or if operated in reverse, break out) for a tripping operation.

The aforementioned apparatus provides distinct advantages over conventional work over and drilling units. For instance, it is capable of making or breaking connections while circulating and tripping pipe in or out of the well bore. Furthermore, it can replace a conventional rotary table and can be rigged up on almost any drilling rig, platform, drill ship or floater. For rig assist, the jacking slips are picked up like a joint of pipe and simply stabbed into the rotary table. The unit fits flush with the rig floor and allows for normal rig pipe handling to be used. In this scenario, there is minimal or no learning curve for the rig personnel to go through, and with there being no loose equipment above the rig floor 8 associated with this apparatus, the possibility of dropped objects has been eliminated.

The unique articulating pipe handling arms 12 and snubbing unit 20 make up provides the apparatus 100 with the ability to make tubular connections "on the fly" with a continual trip speed of over 60 joints per hour being possible.

The apparatus 100 can be broken down into readily liftable components.

It is envisaged that the system will minimise collapse of boreholes and differential sticking without surging the borehole formation.

Modifications and improvements can be made to the embodiments herein described without departing from the scope of the invention.

What is claimed is:

1. An apparatus for inserting or removing a string of tubulars from a borehole, the apparatus comprising:

a make up/break out mechanism which is capable of adding a tubular to or removing a tubular from the string, wherein the make up/break out mechanism is moveable along the direction parallel to the axial direction of the string, such that the string may be substantially continuously inserted into or removed from the borehole, wherein the make up/break out mechanism comprises a pair of vertically spaced slips which are adapted to selectively grip the tubulars, whereby one of the slips is moveable towards and/or away from the other slip; and a handling mechanism which is adapted to feed a tubular into, or remove a tubular from, the make up/break out mechanism, the handling mechanism including at least one substantially vertical track and a rail mechanism movably connected to the at least one substantially vertical track for handling one tubular.

2. The apparatus according to claim 1, wherein the make up/breakout mechanism further comprises a movement mechanism which is capable of moving the said one slip toward or away from the said other slip.

3. The apparatus according to claim 2, wherein the movement mechanism comprises one or more jacking cylinders.

4. The apparatus according to claim 1, wherein the make up/breakout mechanism further comprises a pair of vertically spaced tongs which are adapted to selectively grip the tubulars.

5. The apparatus according to claim 4, wherein the uppermost tong is adapted to impart rotation to a tubular.

6. The apparatus according to claim 4, wherein the make up/breakout mechanism further comprises a movement mechanism which is capable of moving the pair of vertically spaced tongs toward or away from a mouth of the borehole.

7. The apparatus according to claim 6, wherein the movement mechanism capable of moving the pair of vertically spaced tongs toward or away from a mouth of the borehole is the same movement mechanism capable of moving the said one slip toward or away from the said other slip.

8. A method of inserting or removing a string of tubulars from a borehole, the method comprising: providing a make up/break out mechanism which is capable of adding a tubular to or removing a tubular from the string;

providing a handling mechanism which is adapted to feed a tubular into, or remove a tubular from, the make up/break out mechanism;

moving the handling mechanism on at least one substantially vertical track; and moving the make up/break out mechanism along the direction parallel to the axial direction of the string, as it is adding a tubular to or removing a tubular from the string, such that the string is substantially continuously inserted into or removed from the borehole.

9. An apparatus for handling tubulars, the apparatus comprising:

first and second assemblies, each assembly comprising:

a substantially vertical track;

a rail mechanism movably connected to the substantially vertical track; a coupling mechanism, associated with the rail mechanism, for coupling the rail mechanism to a tubular; and a movement mechanism to provide movement to the rail mechanism.

10. The apparatus according to claim 9, wherein the substantially vertical tracks are secured to a frame.

11. The apparatus according to claim 10, wherein the frame is in the form of a derrick of a drilling rig.

12. The apparatus according to claim 11, wherein the derrick is provided with a tubular rack for storing tubulars, and a ramp extends downwardly at an angle from the lower end of the derrick toward the tubular rack, and a tubular guide track provided at one or both sides of the ramp.

13. The apparatus according to claim 9, wherein each pair of substantially vertical track is arranged about the longitudinal axis of a borehole mouth, such that the pair of track each substantially vertical track and the borehole mouth lie on a common plane, with one track at either side of the borehole mouth.

14. The apparatus according to claim 9, wherein the rail mechanism is connected to the respective track by a moveable roller mechanism.

15. The apparatus according to claim 14, wherein the moveable roller mechanism may comprise a motive means to provide movement thereto.

16. The apparatus according to claim 9, wherein the coupling mechanism comprises a member provided with a screw thread thereon for screw threaded engagement with one end of the tubular.

17. A method of handling tubulars, the method comprising:

providing a rail mechanism, the rail mechanism being associated with a coupling mechanism for coupling to a tubular, and the rail mechanism being movably connected to a single substantially vertical track;

coupling the coupling mechanism to a tubular; and operating a movement mechanism to move the rail mechanism.

18. An apparatus for handling a tubular, the apparatus comprising:

a pair of substantially vertical tracks;

a coupling mechanism operatively connected to each track for coupling to a tubular; and a pair of moveable members which are hingedly connected to both the coupling mechanism and the pair of substantially vertical tracks, such that movement of the pair of moveable members results in movement of the coupling mechanism substantially about a longitudinal axis of the track, wherein each moveable member is connected to a separate vertical track.

19. The apparatus according to claim 18, wherein a rail mechanism is provided and which is movably connected to the track.

20. The apparatus according to claim 19, wherein the pair of movable members are hingedly connected to both the coupling mechanism and the rail mechanism.

21. The apparatus according to claim 18, wherein the pair of substantially vertical tracks are arranged about the longitudinal axis of a borehole mouth, such that the pair of tracks and the borehole mouth lie on a common plane, with one track at either side of the borehole mouth.

22. The apparatus according to claim 21, wherein the movement of the pair of movable members results in movement of the coupling mechanism substantially about the longitudinal axis of the track such that a longitudinal axis of a tubular coupled to the coupling mechanism is substantially coincident with the longitudinal axis of the borehole mouth.

23. The apparatus according to claim 18, wherein a motive means is provided to permit movement of the pair of moveable members.

24. A method of handling a tubular, the method comprising:

providing at least one substantially vertical track;

connecting at least one coupling mechanism to the at least one track, the at least one coupling mechanism for coupling to a tubular;

providing at least one moveable member which is hingedly connected to both the coupling mechanism and the at least one vertical track; and moving the at least one moveable member and the at least one coupling mechanism substantially about a longitudinal axis of the at least one track.

25. A method for adding or removing a plurality of tubular sections from a string of tubulars, comprising:

providing a make up/break out mechanism for gripping the tubular sections;

providing a tubular handling mechanism for conveying the tubular sections to the make up/break out mechanism such that an axis of the tubular sections is substantially parallel to an axis of the string of tubulars, the tubular handling mechanism including at least two gripping mechanisms for gripping at least two tubular sections substantially simultaneously; and gripping a first tubular section with the handling mechanism and conveying the first tubular section to the make up/break out mechanism while substantially simultaneously gripping a second tubular section.

26. The method of claim 25, wherein the make up/break out mechanism axially and rotationally grips the tubular sections.

* * * * *

UNITED STATES PATENT AND TRADEMARK OFFICE

CERTIFICATE OF CORRECTION

PATENT NO. : 6,854,520 B1
DATED : February 15, 2005
INVENTOR(S) : Dicky Robichaux It is certified that error appears in the above-identified patent and that said Letters Patent is hereby corrected as shown below:

Title page,
Item [30], Foreign Application Priority Data, please remove "0004354" and replace with -- 0004354.7 --

Column 8,
Line 47, please remove "the pair of track"

Signed and Sealed this

Thirty-first Day of May, 2005

JON W. DUDAS
*Director of the United States Patent and Trademark Office*